US005701798A

United States Patent [19]

Noda

[11] Patent Number: 5,701,798

[45] Date of Patent: Dec. 30, 1997

[54] LINEAR ACTUATING DEVICE

[75] Inventor: Mitsuo Noda, Ichinomiya, Japan

[73] Assignee: Howa Machinery, Ltd., Japan

[21] Appl. No.: 771,661

[22] Filed: Dec. 23, 1996

[30] Foreign Application Priority Data

Dec. 27, 1995 [JP] Japan ..... 7-353897

[51] Int. Cl.[6] ..... F01B 29/00

[52] U.S. Cl. ..... 92/88; 92/165 R; 92/177; 277/DIG. 7

[58] Field of Search ..... 92/88, 165 R, 92/177; 277/DIG. 7

[56] References Cited

U.S. PATENT DOCUMENTS

| | | | |
|---|---|---|---|
| 4,813,341 | 3/1989 | Vaughn | 92/88 |
| 5,207,145 | 5/1993 | Kemner | 92/177 |
| 5,311,810 | 5/1994 | Takada et al. | 92/165 R |
| 5,335,583 | 8/1994 | Kaneko et al. | 92/88 |

FOREIGN PATENT DOCUMENTS

| | | | |
|---|---|---|---|
| 0 350 561 | 1/1990 | European Pat. Off. . | |
| 0 502 810 A1 | 9/1992 | European Pat. Off. . | |
| 82 10627 | 12/1983 | France . | |
| 0 475 032 A1 | 3/1992 | Germany . | |
| 0 492 750 A1 | 7/1992 | Germany . | |
| 0 504 450 A1 | 9/1992 | Germany . | |
| 94 16 523.8 | 12/1994 | Germany . | |
| 62-6508 | 1/1987 | Japan . | |
| 62-041407 | 2/1987 | Japan . | |
| 62-93405 | 6/1987 | Japan . | |
| 63-152003 | 10/1988 | Japan . | |
| 1-141206 | 6/1989 | Japan | 92/88 |
| 7-248006 | 9/1995 | Japan . | |

OTHER PUBLICATIONS

European Search Report dated Apr. 3, 1997 (2 pages).
Communication dated May 12, 1997 (1 page).

*Primary Examiner*—Thomas E. Denion
*Attorney, Agent, or Firm*—Finnegan, Henderson, Farabow, Garrett & Dunner, L.L.P.

[57] ABSTRACT

The linear actuating device of the present invention has a rodless power cylinder unit with a cylinder barrel. An external carriage is disposed on the cylinder barrel and is movable along the axis of the cylinder barrel. A base on which a guide rail is mounted is provided. A slide table is driven by the external carriage of the rodless power cylinder unit and guided by the guide rail. According to the present invention, the external carriage is disposed on the side of the cylinder barrel facing the guide rail. This construction allows the external carriage and the slide table to be accommodated within the height of the cylinder barrel. Therefore, the height of the linear actuating device as a whole can be reduced to substantially the same as the height of the cylinder barrel.

14 Claims, 11 Drawing Sheets

LINEAR ACTUATING DEVICE

BACKGROUND OF THE INVENTION

1. Field of the Invention

The present invention relates to a linear actuating device using a rodless power cylinder unit.

2. Description of the Related Art

A linear actuating devices having a slide body and a rodless power cylinder unit to drive the slide body are disclosed in various publications.

For example:

(A) Japanese Unexamined Utility Model Publication (Kokai) No. 63-152003 discloses a linear actuating device in which a rodless power cylinder unit and a guide rail are mounted on a base. However, in the linear actuating device in this publication, the rodless power cylinder unit is mounted on the base in such a manner that the slit of the cylinder barrel faces upward (i.e., in the direction opposite to the base) and a carriage and the slide body connected to the carriage are mounted at the position above the cylinder barrel.

(B) Japanese Unexamined Patent Publication (Kokai) No. 7-248006 discloses a linear actuating device in which a magnetic type rodless power cylinder unit is used. In the linear actuating device in this publication, a guide rail is disposed in parallel with the rodless power cylinder. However, a base is not provided, and the guide rail and the cylinder barrel of the rodless power cylinder unit are held by clamping both ends of the guide rail and the cylinder barrel between a pair of end plates. Further, shock absorbers are mounted on the end plates so as to engage the slide body to define the ends of its stroke.

(C) Japanese Unexamined Utility Model Publication (Kokai) No. 62-93405 discloses a linear actuating device in which a base is formed as an integral part of the cylinder barrel of the rodless power cylinder unit. In this embodiment, the cylinder barrel and the base is arranged in such a manner that the cross section of the cylinder barrel and the base are L-shaped, and the horizontal part of the L forms the base. A guide rail is mounted on this base, and a carriage of the rodless power cylinder unit is disposed on the upper side of the cylinder barrel. Further, a slide body which is driven by the carriage and guided by the guide rail is disposed above the guide rail and the cylinder barrel.

(D) Japanese Unexamined Utility Model Publication (Kokai) No. 62-6508 discloses a linear actuating device in which a guide rail and a rodless power cylinder unit are mounted inside a U-shaped base. A slide body is driven by a carriage of the rodless power cylinder and guided by the guide rail. Stopper members which define the stroke of the slide body are fixed to the base using a T-shaped cross section groove extending in parallel with the guide rail.

In the linear actuating device disclosed in the above publication (A), since the carriage and the slide body are mounted above the cylinder barrel of the rodless power cylinder unit, the total height of the linear actuating device, i.e., the height from the bottom of the base to the upper face of the slide body is considerably larger than the height of the cross section of the cylinder barrel.

In the linear actuating device disclosed in the above publication (B), since the guide rail is directly coupled with the cylinder barrel of the rodless power cylinder by the end plates, the rigidity of the device is relatively low. Therefore, when mounting the linear actuating device in this publication, it is necessary to fix the guide rail to the mounting structure over its entire length by, for example, plurality of mounting bolt holes disposed along the entire length of the guide rail. Therefore, the application of the linear actuating device in this publication is limited by this mounting method of the device.

In the linear actuating device disclosed in the above publication (C), similar to the device in the above publication (A), since the carriage of the rodless power cylinder unit and the slide body is disposed at the position above the cylinder barrel of the rodless power cylinder unit, the total height of the linear actuating device becomes large.

Further, in the linear actuating device disclosed in the above publication (D), even though the position of the stopper member can be easily adjusted along the T-shaped cross section groove, the fixture of the stopper member to the T-shaped groove tends to become loose due to the impact caused when the slide body engages the stopper member at its stroke end.

SUMMARY OF THE INVENTION

In view of the problems in the related art as set forth above, one of the objects of the present invention is to provide a means for reducing the total height of a linear actuating device without lowering the rigidity of the device as a whole.

Further, another object of the present invention is to provide a means for rigidly fixing the stopper member while allowing an easy adjustment of the position thereof in a linear actuating device which has a small total height.

To achieve the objects and in accordance with the purpose of the invention, as embodied and broadly described herein, the linear actuating device of this invention comprises a rodless power cylinder unit including a cylinder barrel, a longitudinal base rigidly coupled to the cylinder barrel, the base having a width in the direction perpendicular to the axis of the cylinder barrel of the rodless power cylinder, a guide rail mounted on the top face of the base and extending in parallel with the axis of the cylinder barrel, the guide rail capable of bearing both vertical and horizontal forces, a carriage disposed on the cylinder barrel and movable along the axis of the cylinder barrel, a slide table having an upper face and lower face disposed in parallel with the base, the slide table being coupled with and driven by the carriage and movable along the guide rail, wherein the carriage and the slide table are disposed on the side of cylinder barrel facing the guide rail.

According to this aspect of the invention, since the guide rail and the rodless power cylinder are rigidly coupled to the base, the rigidity of the device as a whole is increased. Further, since both the carriage of the rodless power cylinder and the slide body driven by the carriage are disposed on the side of the cylinder barrel facing the guide rail, the height of the upper face from the base can be minimized. Further, if the height of the lower face of the slide body is made lower than the largest height of the cylinder barrel, the total height of the device can be reduced to substantially the same as the largest height of the cylinder barrel. Therefore, the height of the linear actuating device can be minimized without reducing the rigidity of the device as a whole. The slide body and the cylinder barrel may partly overlap each other, or may have no overlapped portion when viewed from the direction perpendicular to the upper and lower face.

According to another aspect of the present invention, the linear actuating device as set forth above further comprises a stopper means for defining the end of the stroke of the slide body, the stopper means is provided with a stopper member holder having a groove engaging the guide rail so as to facilitate adjustment of the position of the stopper member along the guide rail, a fastening means for fastening the stopper member holder to the base, and a stopper member mounted on the stopper member holder at the position offset from the guide rail in the direction to the cylinder barrel, the stopper member defines the end of the stroke of the slide body by engaging the slide body at the end of the stroke.

In this aspect of the invention, the stopper member is mounted on the stopper member holder at the position offset from the guide rail in the direction to the cylinder barrel. Therefore, the height of the stopper member holder can be lowered without causing interference between the guide rail and the stopper member. Further, the stopper means engages with the guide rail by the groove thereof, therefore, the impact caused by the engagement with the slide body can be received by the guide rail. Thus, the fixture of the stopper means is not loosened by the impact caused by the impact even during extended operation of the device.

BRIEF DESCRIPTION OF THE DRAWINGS

The present invention will be better understood from the description as set forth hereinafter, with reference to the accompanying drawings in which.

DESCRIPTION OF THE PREFERRED EMBODIMENT

Figure 1:
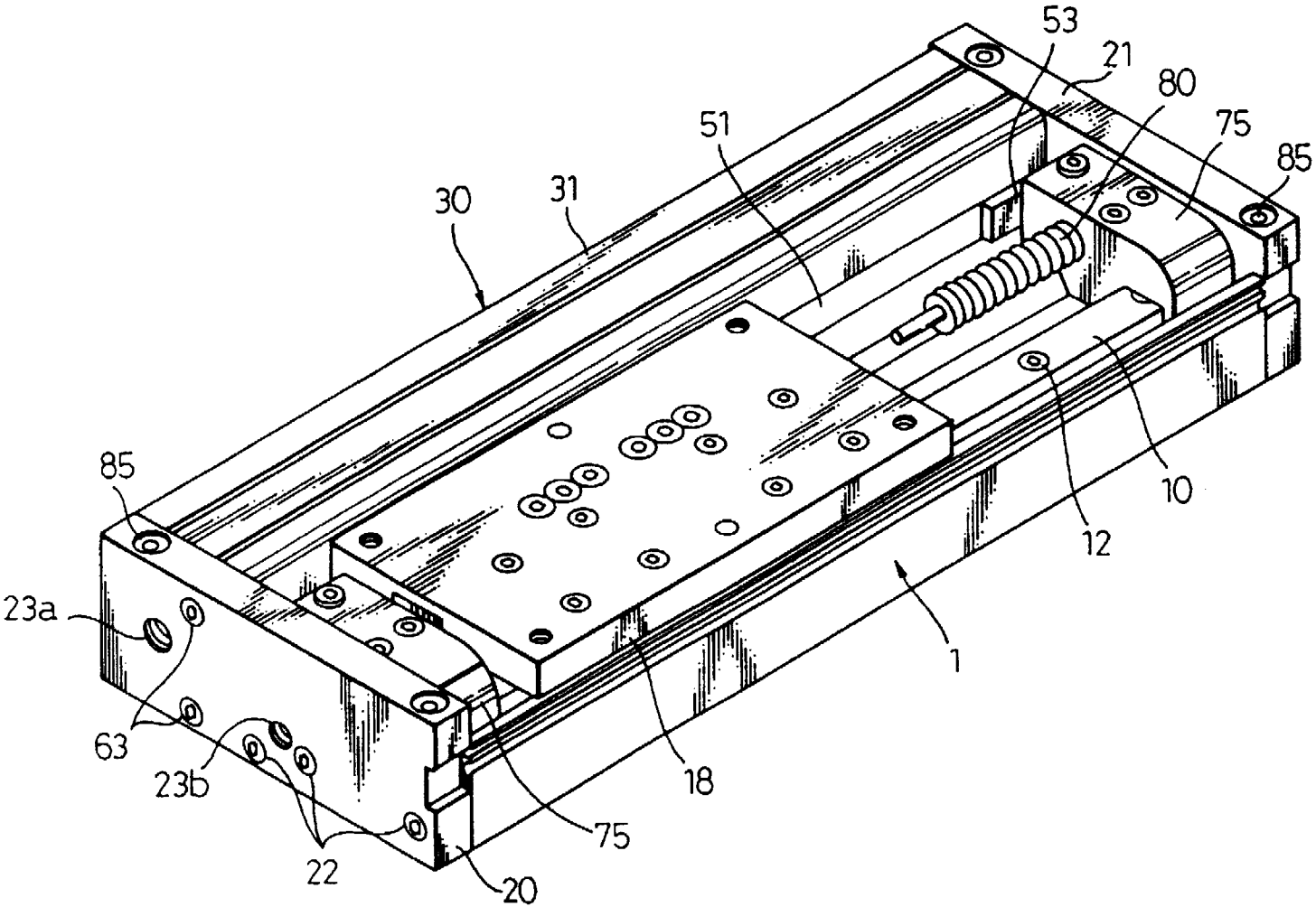
FIG. 1 is a perspective view of an embodiment of a linear actuating device according to the present invention.
Figure 2:
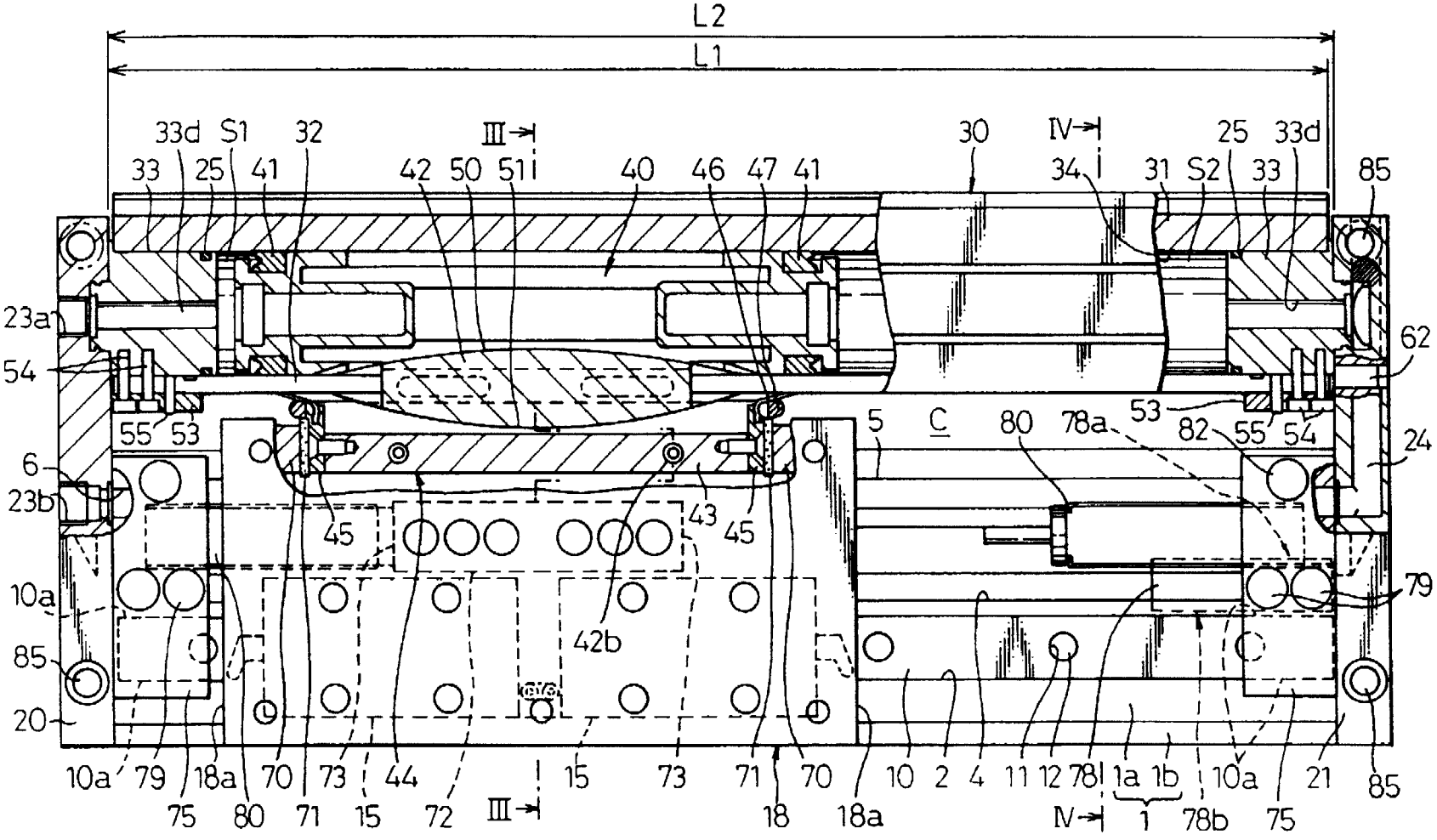
FIG. 2 is a partial sectional plan view of the linear actuating device in FIG. 1.
Figure 3:
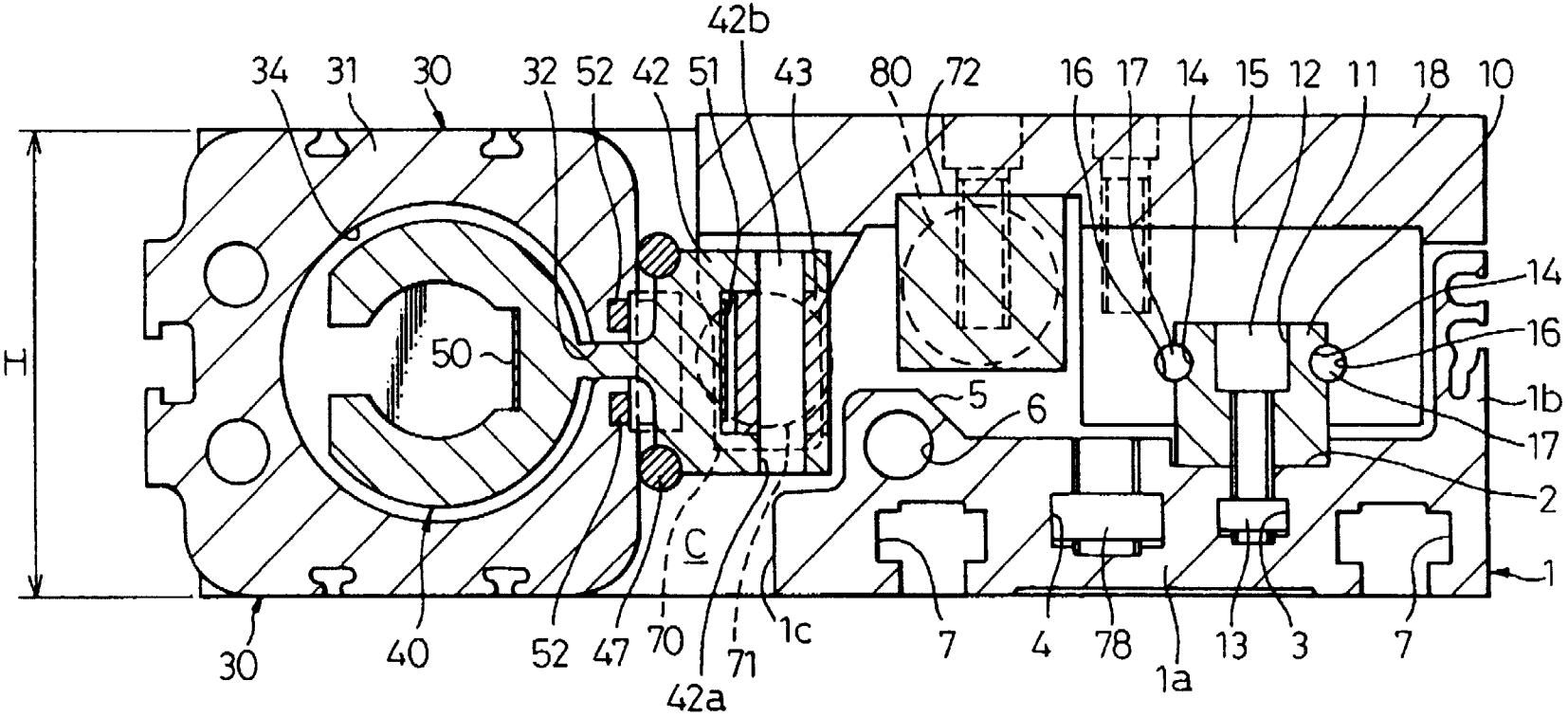
FIGS. 3 is a cross sectional view taken along the line III—III in FIG. 2.

FIGS. 1 through 3 show an embodiment of a linear actuating device having a rodless power cylinder unit according to the present invention. In FIGS. 1 through 3, reference numeral 1 designates a base of the linear actuating device. The base 1 has a L-shaped cross section having a bottom 1*a* and a side wall 1*b* disposed at the side of the bottom 1*a* and perpendicular thereto. A shallow groove 2 is provided on the upper face of the bottom 1*a* along its entire length. This groove 2 is used for mounting a guide rail 10 to the base 1. As best shown in FIG. 3, a T-shaped groove (a groove having a T-shaped cross section) 3 is provided on the bottom surface of the groove 2 along its entire length. Further, another T-shaped groove 4 for mounting a stopper member holder 75 runs in parallel to the groove 2 on the upper face of the base 1 on the side of the groove 2 opposite to the side wall 1*b*. The T-shaped groove 4 is also provided over the entire length of the base 1.

A ridge 5 is formed on the upper face of the base 1 at the side 1*c* opposite to the side wall 1*b*. The ridge 5 is formed on the base 1 along the entire length. As shown in FIG. 3, the ridge 5 accommodates a passage 6 for a working fluid.

On the lower face of the bottom 1*a*, a pair of T-shaped grooves 7 are provided along the entire length of the bottom 1*a*. The grooves 7 are used for mounting the linear actuating device on other machines. The base 1 in this embodiment is made of aluminum alloy and manufactured by an extrusion process.

The guide rail 10 having a length slightly smaller than the length of the base 1 is disposed in the groove 2 of the base 1. The guide rail 10 has a plurality of bolt holes 11 disposed along the length of the rail 10. The guide rail 10 is mounted on the base 1 by threading mounting bolts 12 into the bolt holes 11 so that the bolts 12 engage with nuts 13 disposed in the T-shaped groove 3. The guide rail 10 is provided with a guide groove 14 on each side thereof which extends over the entire length of the guide rail 10. Though the guide grooves 14 in this embodiment have a semicircular cross section, the guide grooves 14 may have a V-shaped cross section.

Numeral 15 in FIGS. 2 and 3 designates a guide member of the linear actuating device which is guided by the guide rail 10. In this embodiment, two guide members 15 are provided. Each of the guide members 15 straddles and slides on the guide rail 10, and is provided with ball grooves 16 at the portion facing the respective guide grooves 14 of the guide rail 10. The ball grooves 16 and the guide grooves 14 forms passages of balls 17 which act as ball bearings supporting the guide members 15 on the guide rail 10. The guide members 15 are connected to a lower face of a slide table 18. Though two guide members 15 are provided in this embodiment, number of the guide members is not limited to two in the present invention.

Numerals 20 and 21 are rectangular end plates which are mounted to the base 1 at the both ends thereof by mounting bolts 22. The respective end plates 20, 21 extend perpendicular to the longitudinal axis of the base 1 in such a manner that the ends of the end plates 20 and 21 extend over the side 1*c* (the side opposite to the side wall 1*b*) of the base 1. As shown in FIG. 3, the heights of the end plates 20 and 21 are made substantially the same as the height H (the height measured in the direction perpendicular to the slit 32) of the cylinder barrel 31 of the rodless power cylinder unit 30 so that a space C for accommodating the rodless power cylinder unit 30 is formed between the end plates 20 and 21. As shown in FIG. 3, the rodless power cylinder unit 30 is disposed between the end plates 20 and 21 in parallel to the guide rail 10.

Figure 6:
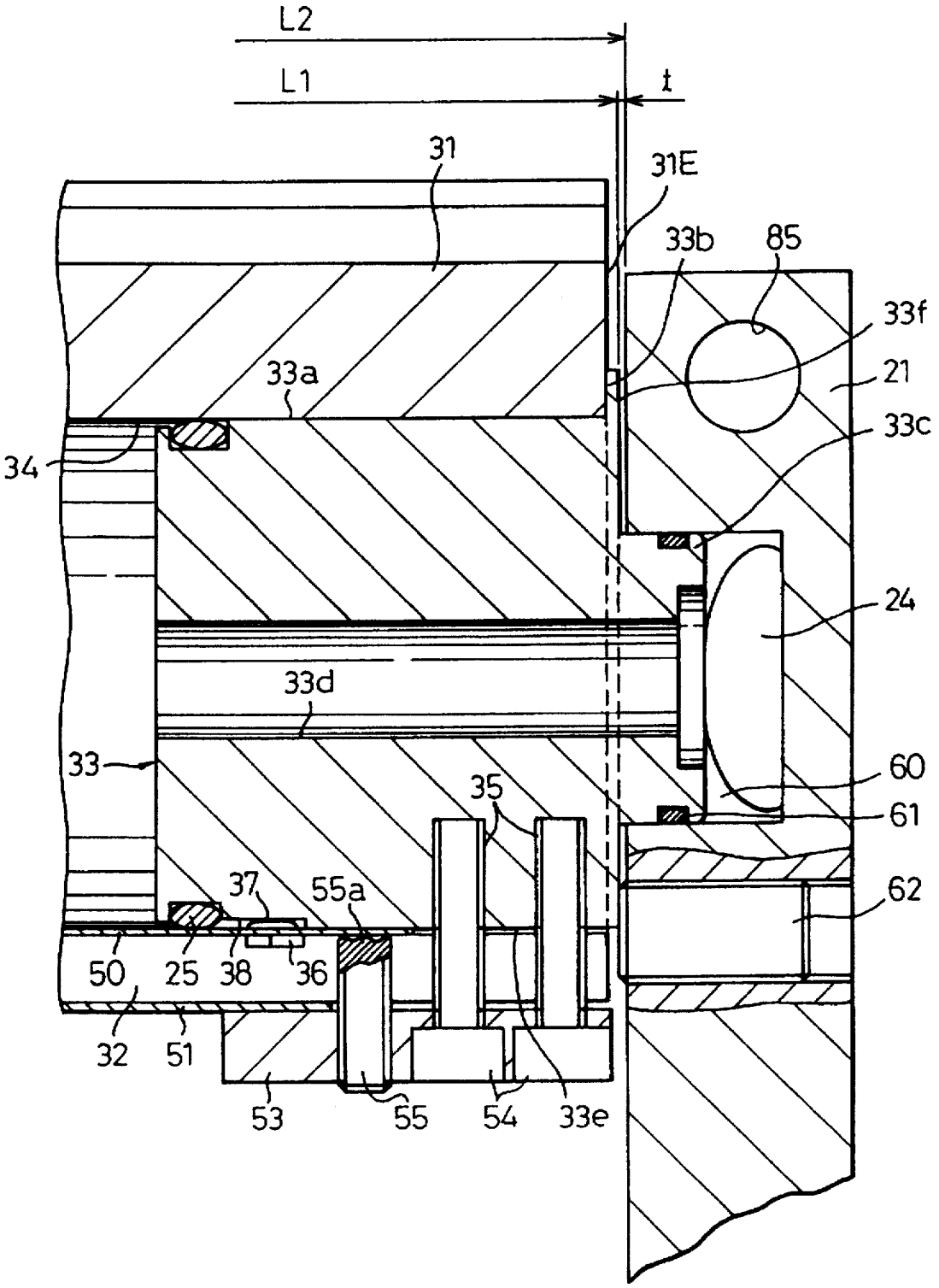
FIG. 6 is an enlarged sectional view of the rodless power cylinder in FIG. 1 which explains the fixture of the ends of the inner and outer seal bands.

The cylinder barrel 31 of the rodless power cylinder unit 30 has a cross section substantially in a rectangular shape. A slit 32 is provided on the side wall of the cylinder barrel 31 along the entire length thereof. The respective ends of the cylinder barrel 31 are plugged by a plug member 33. FIG. 6 shows the detail of one of the ends of the cylinder barrel 31 (the right hand side end in FIG. 2). As shown in FIG. 6, the plug member 33 comprises a plug portion 33*a* and a thin flange portion 33*b*, and a portion 33*c* which fits into the recessed portion 60 of the end plates 20 and 21.

In the bore 34 of the cylinder barrel 31, a piston 40, which is movable along the longitudinal axis of the cylinder barrel 31, is disposed. As shown in FIG. 2, the plug members 33 on both ends of the cylinder barrel 31 and the piston 40 define two cylinder chambers S1 and S2 in the cylinder barrel 31. Further, a connecting passage 33*d* which opens to the corresponding cylinder chambers S1 and S2 on the both sides of the piston 40 is provided in the respective plug members 33. The plug members 33 are mounted to the ends of the cylinder barrel 31 only by inserting the plug portions 33*a* into the bore 34 of the cylinder barrel 31, i.e., no other fixing means such as fixing bolt is used for mounting the plug members 33 on the cylinder barrel 31. An annular seal member 25 which may be an O-ring seal is mounted on the periphery of the end of the plug portion 33*a* to seal the clearance between the plug portion 33*a* and the wall of the bore 34.

Figure 4:
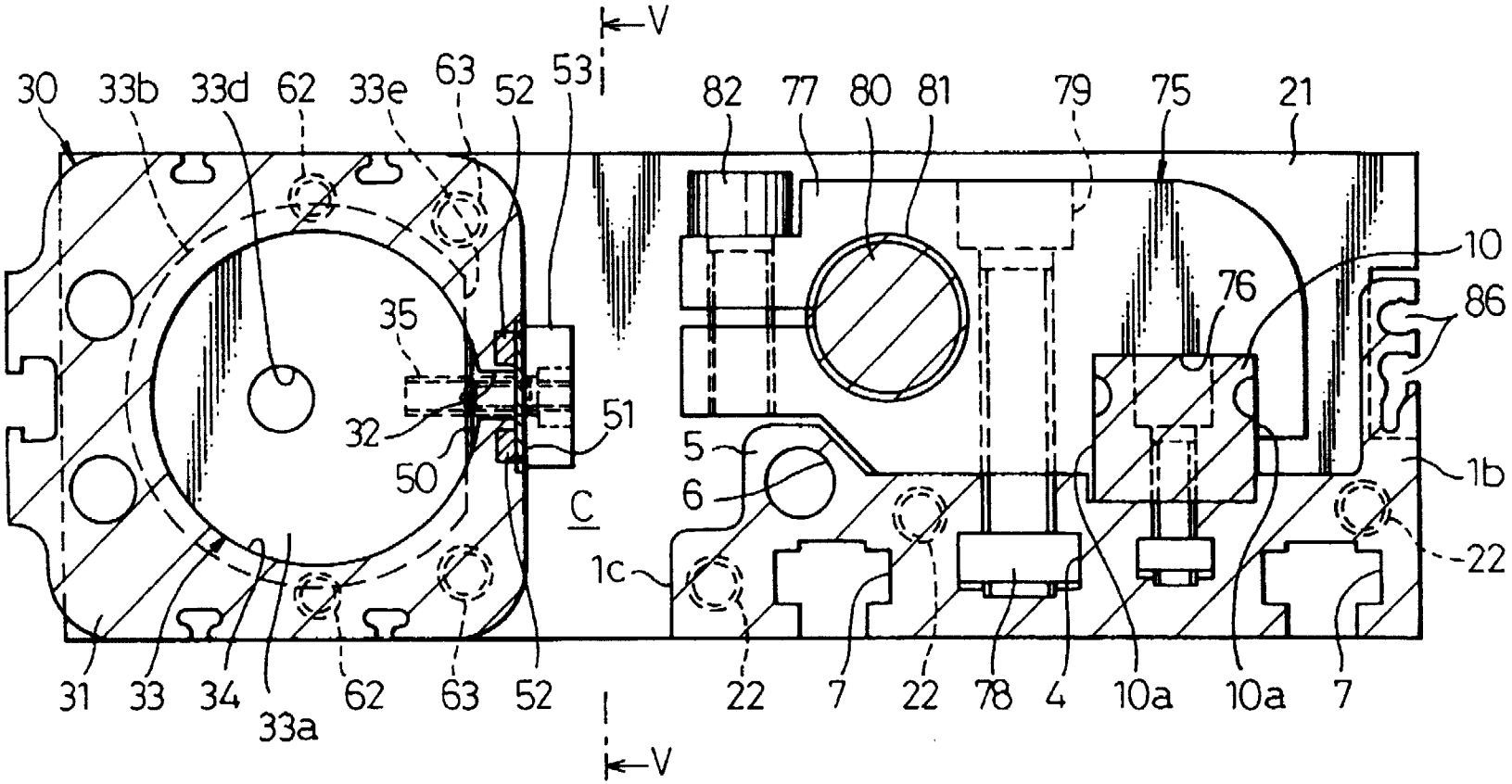
FIG. 4 is a cross sectional view taken along the line IV—IV in FIG. 2.
Figure 5:
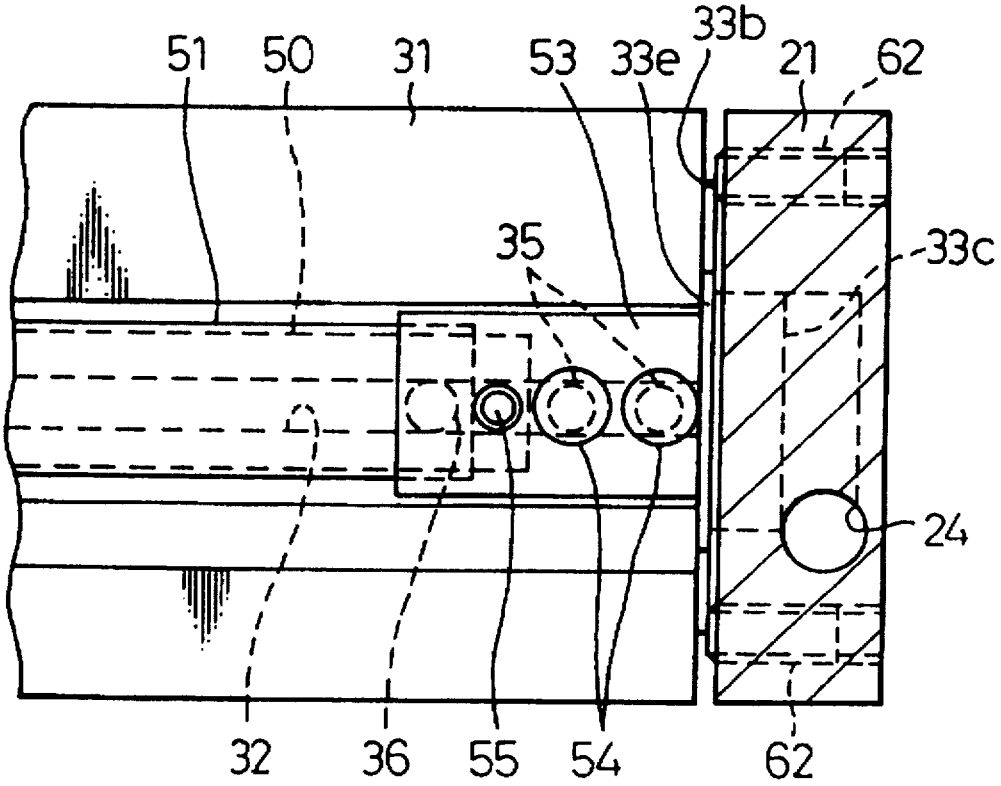
FIG. 5 shows the section of the linear actuating device taken along the line V—V in FIG. 4.

FIG. 4 is a cross sectional view along the line IV—IV in FIG. 2. As shown in FIG. 4, a part of the plug portion 33*a* and the flange portion 33*b* of the plug member 33 are machined to form a flat portion 33*e* on the side of the plug member 33. As explained later, the flat portion 33*e* is used to facilitate the insertion of the inner seal band between the wall of the bore 34 and the plug member 33 and sliding movement thereof to the direction along the longitudinal axis of the cylinder barrel 31. On the flat portion 33*e* of the plug member 33, two threaded screw holes 35 are disposed at the center of the width of the flat portion 33*e* and arranged in the longitudinal direction of the plug member 33. Further, a groove 38 is provided on the flat portion 33*e*, as best shown in FIG. 6. The groove 38 is disposed at the center of the width of the flat portion 33*e* on the portion between the tip of the plug portion 33*c* and the threaded holes 35. In this embodiment, a washer 36 is attached to each end of the inner seal band 50 by a rivet 37. The groove 38 is provided for accommodating the head of the rivet 37. As shown in FIG. 5, the washer 36 fits into the width of the slit 32 and prevents the inner seal band 50 from deflecting to the direction perpendicular to the slit 32. However, if an appropriate type of the seal band, for example, an elastic seal band having a lip portion fitting into the slit 32 for preventing the deflection of the seal band is used, the washer 36 is not required.

The piston 40 is disposed in the bore 34 and is movable in the axial direction of the cylinder barrel 31. As best shown in FIG. 2, a piston packing 41 is provided on each side of the piston 40. Therefore, two cylinder chambers S1 and S2 are defined in the bore 34 of the cylinder barrel 31 by the piston 40. In this embodiment, a part of piston 40 forms a yoke 42 which protrudes to the outside of the cylinder barrel 31 through the slit 32. A mount 43 is coupled to the yoke 42 by means of a plurality of holes 42*a* disposed on the yoke 42 and pins 42*b* fitting into the holes 42*a*. An edge plate 45 is attached to each of the axial ends of the mount 43. The mount 43 and the edge plates 45 in this embodiment form an external carriage 44, and the yoke 42 forms a coupling member for connecting the carriage 44 to the piston 40. A scraper 46 is attached to each of the edge plates 45. The scrapers are held in place by an O-ring 47 which surrounds the periphery of the carriage 44. An inner seal band 50 which is disposed inside the cylinder barrel 31 and closes the inner opening of slit 50 and an outer seal band 51 which is disposed outside the cylinder barrel 31 and closes the outer opening of the slit 32 are provided. The inner seal band 50 and outer seal band 51 are guided by guide surfaces in the yoke 42 and run through the carriage 44.

In this embodiment, the inner seal band 50 and the outer seal band 51 are formed as a thin flexible band which made of, for example, a magnetic substance such as stainless chrome steel. In this embodiment, magnetic strips 52 are embedded on the outer surface of the cylinder barrel 31 on both sides of the slit 32. Therefore, both the inner seal band 50 and the outer seal band 51 are attracted to the magnetic strips 52 and positively seal the inner and outer openings of the slit 32. Though the seal bands made of magnetic substance are used in this embodiment, flexible seal bands of another type may be used. For example, the seal bands may be made of urethane rubber or nylon, or a combination of chrome steel and rubber. Further, instead of using magnetic strips 52, seal bands may be designed in such a manner that the inner seal band and the outer seal band flexibly engage with each other, or the respective seal bands flexibly engage with the slit 32 in order to seal the slit 32.

FIG. 5 shows an example of the fixture of the inner and outer seal bands to the plug member 33. As shown in FIG. 5, the end portion of the outer seal band 51 is fixed to the outer surface of the cylinder barrel 31 by clamping the end of the outer seal band 51 between a fitting plate 53 and the outer wall surface of the cylinder barrel 31. In this embodiment, the fitting plate is fixed to the cylinder barrel 31 by urging it to the outer surface of the cylinder barrel by two mounting bolts 54. As shown in FIG. 5, the mounting bolts 54 are threaded into the threaded holes 35 on the plug portion 33*a* of the plug member 33 through the holes provided on the fitting plate 53 and, then, through the slit 32, and the end of the outer seal band is clamped between the cylinder barrel 31 and the fitting plate 53 at the portion inside a securing screw 55 explained later. On the other hand, the end of the inner seal band 50 is fixed to the plug member 33 by clamping the end of the inner seal band 50 between the surface of the plug member 33 and the securing screw 55 in such a manner that the rivet 37 of the inner seal band 50 is accommodated in the groove 38 disposed on the plug portion 33*a* of the plug member 33. In this condition, the washer 36 fits into the slit 32 and, thereby, the movement of the inner seal band 51 to the direction perpendicular to the slit 32 is restricted. The securing screw 55 is threaded into the threaded hole provided on the fitting plate 53 until the pointed tip 55*a* thereof goes through the slit 32 and bites into the surface of the inner seal band 50. Therefore, the inner seal band 50 is securely fixed to the plug portion 33*a* by the bolt 55.

Next, an embodiment of the arrangement for mounting the cylinder barrel 31 between the end plates 20 and 21 is explained with reference to FIG. 6. As explained before, the plug members 33 are only clamped between the cylinder barrel 31 and the end plates 20 and 21 without using any mounting bolt. The distance between the end plates 20 and 21 (L2 in FIG. 6) is made slightly larger than the distance between the outer faces 33*f* of the flange 33*b* when the plug members 33 are inserted into the cylinder barrel 31 (L1 in FIG. 6). This is required to facilitate the assembly of the cylinder barrel 31 and the end plates 20 and 21. In the assembled condition, the portion 33*c* of the plug member 33, with an O-ring seal 61, fits in the recess 60 disposed on each of the end plates 20 and 21. In this embodiment, as shown in FIG. 6, one of the end plates (in this embodiment, right hand side end plate 21) is provided with a clamping screw 62 at the portion facing the flange portion 33*b* of the plug member 33. The end plates 20, 21 are attached to the end faces of the cylinder barrel 31 by mounting bolts 63 (FIG. 1) after urging the flange portion 33*b* of the plug member 33 by the clamping screw 62 on the end plate 21 toward the other end plate 20. In this condition, a small clearance t remains between the face 33*f* of the flange portion 33*b* and the end plate 21.

In the other end plate 20, an inlet port 23*a* for working fluid is disposed at the portion facing the left hand end of the working fluid passage 6 in the base 1, and an outlet port 23*b* for working fluid is disposed at the portion facing the end of the connecting passage 33*d* in the plug member 33, as shown in FIG. 2. Further, a connecting passage 24 which connects the fluid passage 6 to the connecting passage 33*d* of the plug member 33 on the right hand side in FIG. 2 is provided in the end plate 21. Therefore, inlet and outlet pipes of the working fluid can be connected to only one of the end plates (the end plates 20 in this embodiment). Alternatively, the inlet port and outlet port may be provided separately on the respective end plates.

In FIG. 2, the slide table 18 is coupled to the guide member 15 at its side near the side wall 1*b*. The slide table 18 extends from the portion where it is coupled to the guide member 15 to the portion above the external carriage 44, i.e., the slide table 18 does not overlap the cylinder barrel 31 when viewed from above. On the bottom of the slide table 18, a pair of legs 70 are provided at the portions astride the external carriage 44. The external carriage 44 is clamped between the legs 70 of the slide table via resilient dampers 71 disposed between the edge plates 45 and the legs 70 so that the slide table 18 is driven by the piston 40.

In FIG. 2, numeral 72 shows a stopper which has a length shorter than the length of the slide table 18. The stopper 72 is disposed on the bottom of the slide table in such a manner that end faces 73 thereof are located inside the axial ends 18*a* of the slide table 18. As best shown in FIGS. 2 and 4, the stopper member holders 75 are disposed in parallel to the end plates 20 and 21. The stopper member holder 75 has a groove 76 which fits to the guide rail 10. Further, the stopper member holder 75 is fixed to the base 1 by means of the bolt 79 which engages with a nut member 78 in the T-shaped groove 4 on the base 1. Therefore, the position of the stopper member holder 75 in the axial direction of the cylinder barrel 31 can be adjusted arbitrarily by positioning the nut member 78 in the groove 4.

The vertical faces of the groove 76 closely contact the vertical faces 10*a* and 10*b* of the guide rail 10, and do not contact the faces of the guide grooves 14. Further, the nut member 78 in this embodiment has an extended portion 78*b* extending in the T-shaped groove 4, as shown in FIG. 2. The stopper member holder 75 is provided with a threaded hole 81 to receive the shock absorber 80 by engaging the thread provided on the outer surface of the shock absorber 80 with the internal thread of the hole 81. A notch and a mounting screw 82 are provided at the tip 77 of the stopper member holder 75 in order to secure the shock absorber 80 in the hole 81. When the shock absorber 80 is secured in the hole 81, the shock absorber 80 protrudes from the holder 75 toward the inside of the end plate, i.e., toward the stopper 72 of the slide table 18. In certain applications of the linear actuating device, the shock absorber 80 need not be used. Numerals 85 in FIG. 2 are through holes penetrating the end plates 20 and 21 for mounting the linear actuating device to other structure and numeral 86 in FIG. 4 is a groove for mounting auxiliary devices such as switches to the linear actuating device.

In the linear actuating device shown in FIGS. 1 through 4, since the guide rail 10 is fixed to the base 1, and the rodless power cylinder unit is mounted between the end plates 20 and 21 which are also fixed to the base 1. Therefore, even if the linear actuating device is mounted to other structures by the holes 85 on the end plates, the guide rail 10 is rigidly supported by the base 1 (which is rigidly connected to the end plates 20 and 21). Therefore, according to the linear actuating device in the present embodiment, the smooth movement of the slide table 18 is always maintained. Further, since the connecting member (yoke) 42 connecting the piston 40 and the carriage 44 protrudes from the slit 32 in the direction parallel to the bottom 1*a* of the base 1 and the slide table (i.e., horizontally, in FIGS. 3 and 4 in this embodiment), total height of the linear actuating device can be reduced to that substantially the same as the height of the cylinder barrel 31 (the height H in FIG. 3). Therefore, according to the present embodiment a very compact and rigid linear actuating device is provided.

Figure 11A:
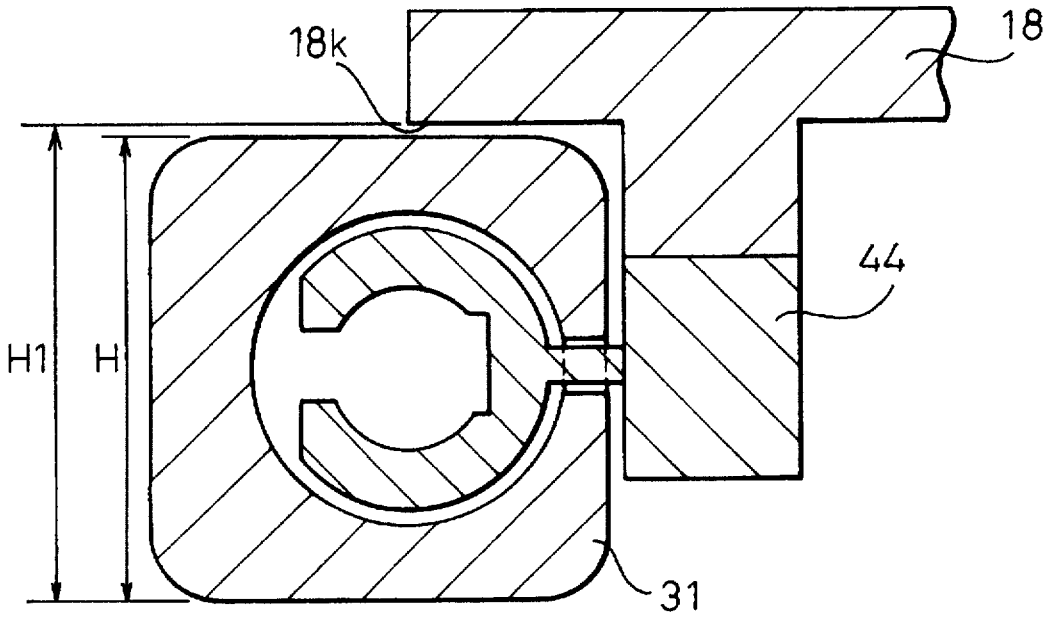
FIGS. 11(A) and 11(B) are drawings schematically showing embodiments of the present invention in which the slide table and the cylinder barrel overlap each other.
Figure 11B:
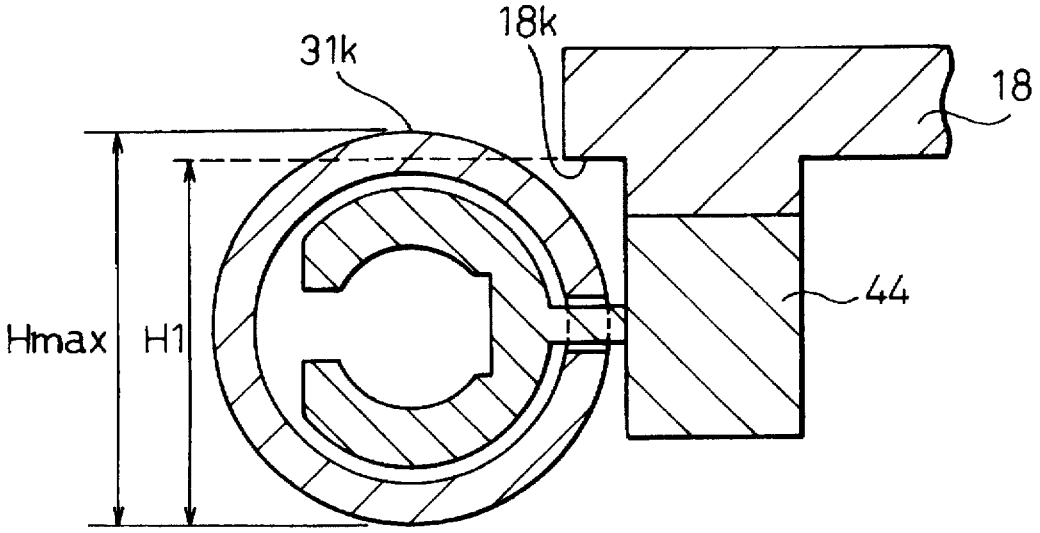

Note that, though the slide table and the cylinder barrel has no overlapped portion when viewed from the direction perpendicular to the upper face of the slide table (i.e., direction along the height H in FIG. 3), a portion of the cylinder barrel may be overlapped with the slide table when viewed from the direction along the height H. FIGS. 11(A) and 11(B) schematically illustrates an example of the linear actuating device according to the present invention in which the slide table 18 and the cylinder barrel 31 partially overlap each other. FIG. 11(A) shows the case in which the height H1 of the lower face 18*k* of the slide table 18 is larger than the height H of the cylinder barrel 31. Since the carriage 44 is not disposed between the top surface of the cylinder barrel 31 and the slide table 18 according to the present invention, the total height of the device can be reduced largely compared to the device in the related arts even though the slide table 18 and the cylinder barrel 31 overlap each other. Further, if the top surface of the cylinder barrel is not flat as shown in FIG. 11(B), the total height of the device can be minimized by making lower the height H1 of the lower face 18*k* of the slide table 18. In FIG. 11(B), since the cylinder barrel 31 has a circular cross section, the top surface 31*k* of the cylinder barrel is not flat. In this case, as shown in FIG. 11(B), by making the height H1 of the lower face 18*k* of the slide table 18 smaller than the largest height Hmax of the cylinder barrel 31, the total height of the device can be reduced to substantially the same as the largest height Hmax of the cylinder barrel 31.

When the working fluid such as pressurized air is supplied, the piston 40 of the cylinder barrel 31 moves along the axis of the cylinder barrel and, thereby, the slide table 18 is driven by the carriage 44 on the guide rail 10. When the slide table reaches the end of its stroke, the end face 73 of the stopper 72 strikes the shock absorber 80. Thus, the slide table 18 stops smoothly at its stroke end since the impact of the engagement of the stopper with the stopper member (i.e., shock absorber) is reduced by the shock absorber 80. When the stopper 72 engages with the shock absorber 80, a torque is exerted on the stopper member holder 75. For example, a clockwise torque is exerted on the holder 75 on the right hand side of FIG. 1. However, since the holder 75 is fixed to the guide rail 10 by the groove 76, this torque is received by the base 1 through the guide rail 10. Therefore, the stopper member holder 75 is maintained at a proper position even after a long operating period. Further, the torque is also exerted by the engagement of the stopper and the shock absorber in the direction in which the holder 75 is raised from the base 1. However, since the nut member 78 in this embodiment is provided with the extended portion 78*b*, this moment is also conveyed to and received by the base 1. Thus, the loosening of the mounting bolts 79 are prevented. The guide rail 10 contacts the holder 75 by the vertical faces 10*a*, 10*b*, and the guide grooves 14 does not contact the holder 75. Therefore, the movement of the guide member 15 is not affected by the engagement of the stopper and the shock absorber. Further, since the stopper 72 is disposed at the position inside the side faces of the slide table, according to the present embodiment, the stroke of the slide table can be kept long while keeping the length of the linear actuating device small.

During the operation of the linear actuating device, the plug members 33 on the both end of the cylinder barrel 31 receive the working fluid pressure in the cylinder chambers S1 and S2. Further, in the linear actuating device in which the shock absorber 80 is not used, the piston 40 moves to the end of its stroke and strikes the plug members 33. When the piston 40 strikes the plug member 33, the plug member 33 receives the force from the piston 40 and is pushed toward the end plate. As explained before, the distance between the end plates 20, 21 is made slightly larger than the distance between the flange faces 33*f*. Further, the plug members 33 is not fixed to the cylinder barrel 31. Therefore, when the plug members 33 receives the forces from the piston and from the working fluid, the plug member 33 tends to move towards the end plate. If the plug member moves toward the end plate (especially, toward the end plate 21, since the clearance t exists between the flange face 33*f* and the end plate 21), the inner seal band 50 and outer seal band 51 are pulled by the plug member 33. This causes excessive tension in the inner and outer seal bands, and may shorten the service life of the seal bands. However, according to the present embodiment, a clamping screw 62 is provided on the end plate 21 and always urges the flange portion 33*b* towards the opposite end plate 20. Therefore, the force exerted on the plug member 33 is received by the end plates through the clamping screw and, thereby, the plug members are held in place. Thus, according to the present embodiment, the excessive tension is not exerted on the seal bands.

Figure 7:
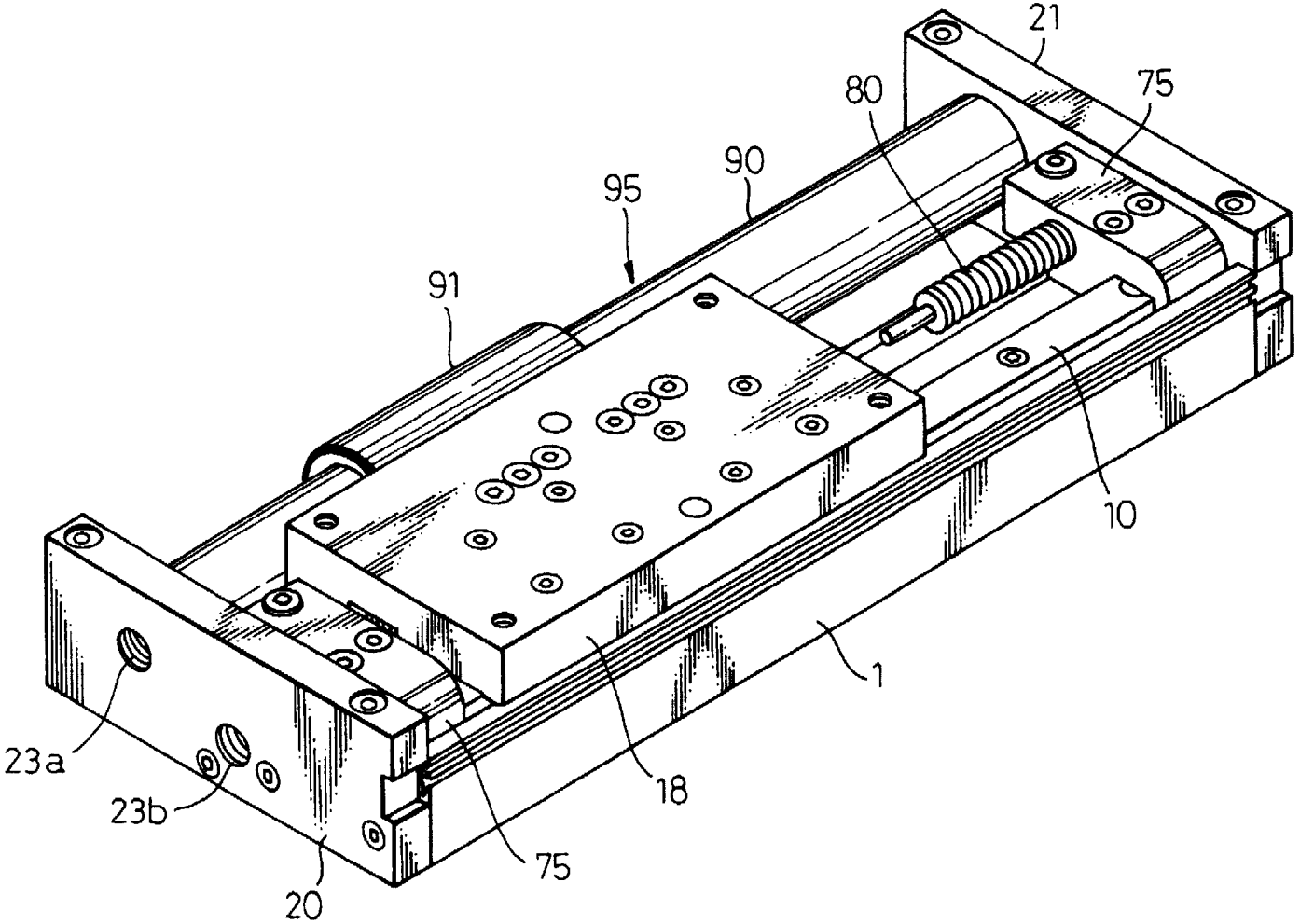
FIG. 7 is a perspective view of another embodiment of a linear actuating device according to the present invention which utilizes a magnetic type rodless power cylinder unit.

FIG. 7 shows another embodiment of the linear actuating device of the present invention. In the linear actuating device of the previous embodiment, the carriage of the rodless power cylinder is coupled to the piston by the yoke protruding from the piston through the slit disposed on the flank of the cylinder barrel. However, in the embodiment in FIG. 7, a magnetic type rodless power cylinder unit 95 is used. The magnetic type rodless power cylinder unit 95 has a cylinder barrel 90 having no slit thereon, and a piston (not shown) in the cylinder barrel 90. The external carriage 91 and the piston are coupled by a magnetic force generated by a magnetic device disposed on the carriage or the piston. As shown in FIG. 7, the present invention can be applied to the linear actuating device utilizing a magnetic type rodless power cylinder unit.

Figure 8:
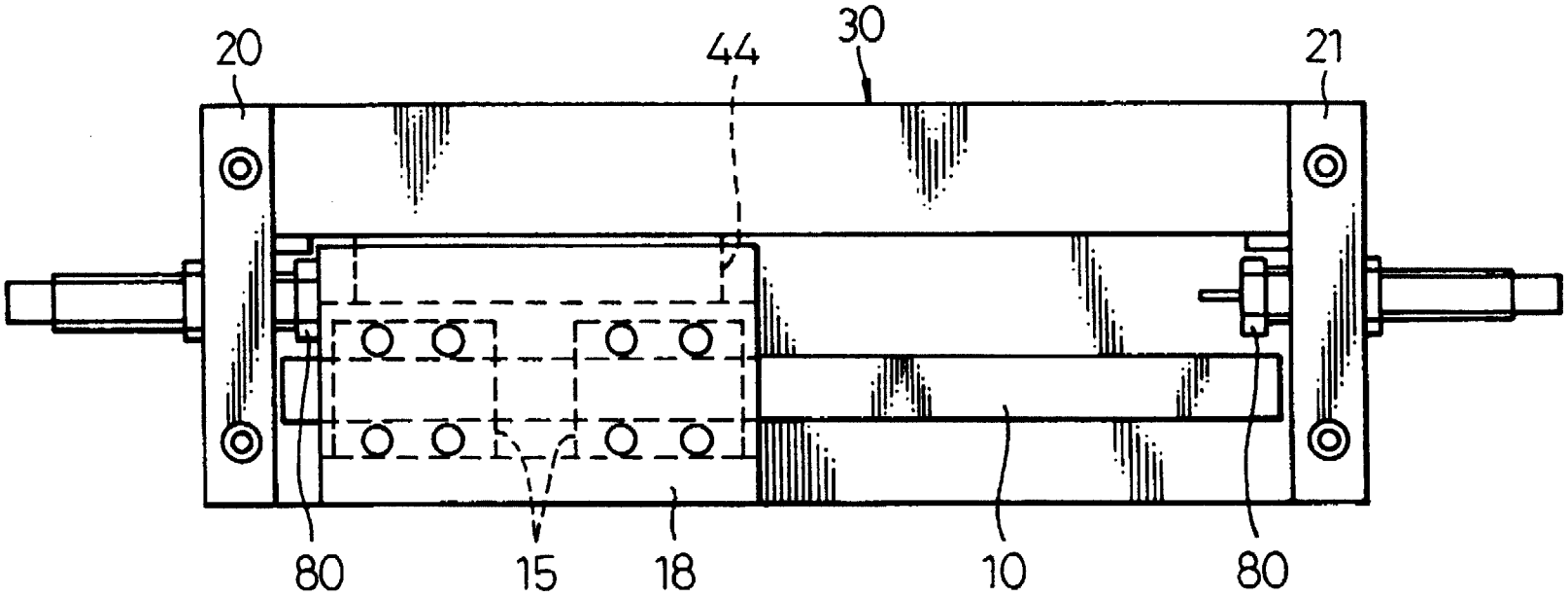
FIG. 8 is a plan view of the linear actuating device which shows an example of the method for fixing a shock absorber.

Further, according to the present invention, the height of the linear actuating device can be further reduced by omitting the stopper member holder 75 in FIGS. 1 and 7. FIG. 8 shows an embodiment of the linear actuating device of the present invention in which the shock absorbers 80 are directly fixed to the end plates 20 and 21 without using the stopper member holders. By the construction as shown in FIG. 8, the height of the linear actuating device can be further reduced.

Figure 9:
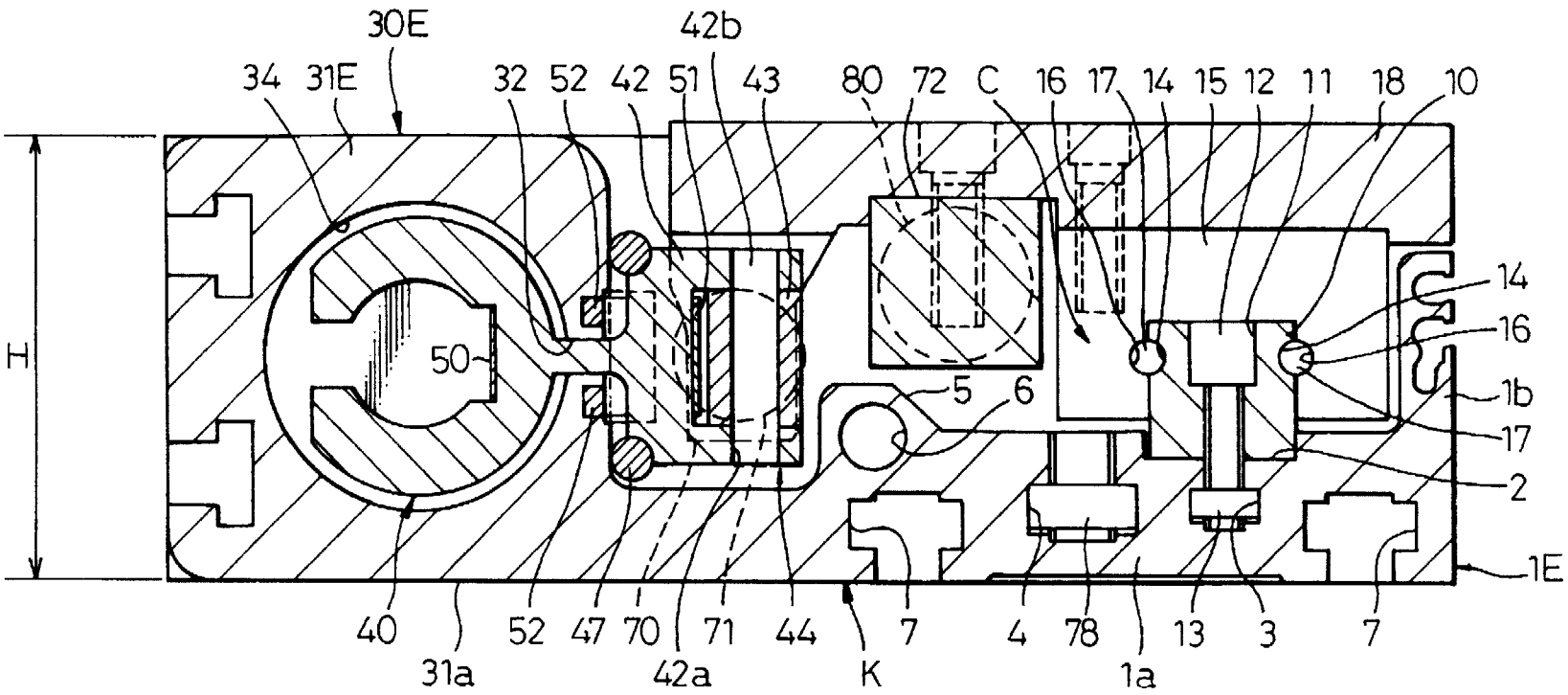
FIG. 9 is a sectional drawing similar to FIG. 3, which shows another embodiment of the linear actuating device according to the present invention.

FIG. 9 shows another embodiment of the linear actuating device according to the present invention. In FIG. 9, reference numerals the same as those in FIGS. 1 through 7 represent the same elements.

In this embodiment, as shown in FIG. 9, a base 1E is formed as an integral part of a cylinder barrel 31E of the rodless power cylinder unit 30E. Namely, the bottom wall 31*a* of the cylinder barrel 31E in this embodiment extends horizontally in FIG. 8 and forms an integral base 1E. Further, side wall 1*b* extends upward from the end of the base 1E. The cylinder barrel 31E, the base 1E and the side wall 1*b* forms a U-shaped body K of the linear actuating device. All of the guide rail 10, guide member 15, slide table 18 and the external carriage 44 are accommodated in a space C which is defined by the cylinder barrel 31E, the base 16 and the side wall 1E. The body K in this embodiment is, for example, made of aluminum alloy using an extrusion process.

Figure 10:
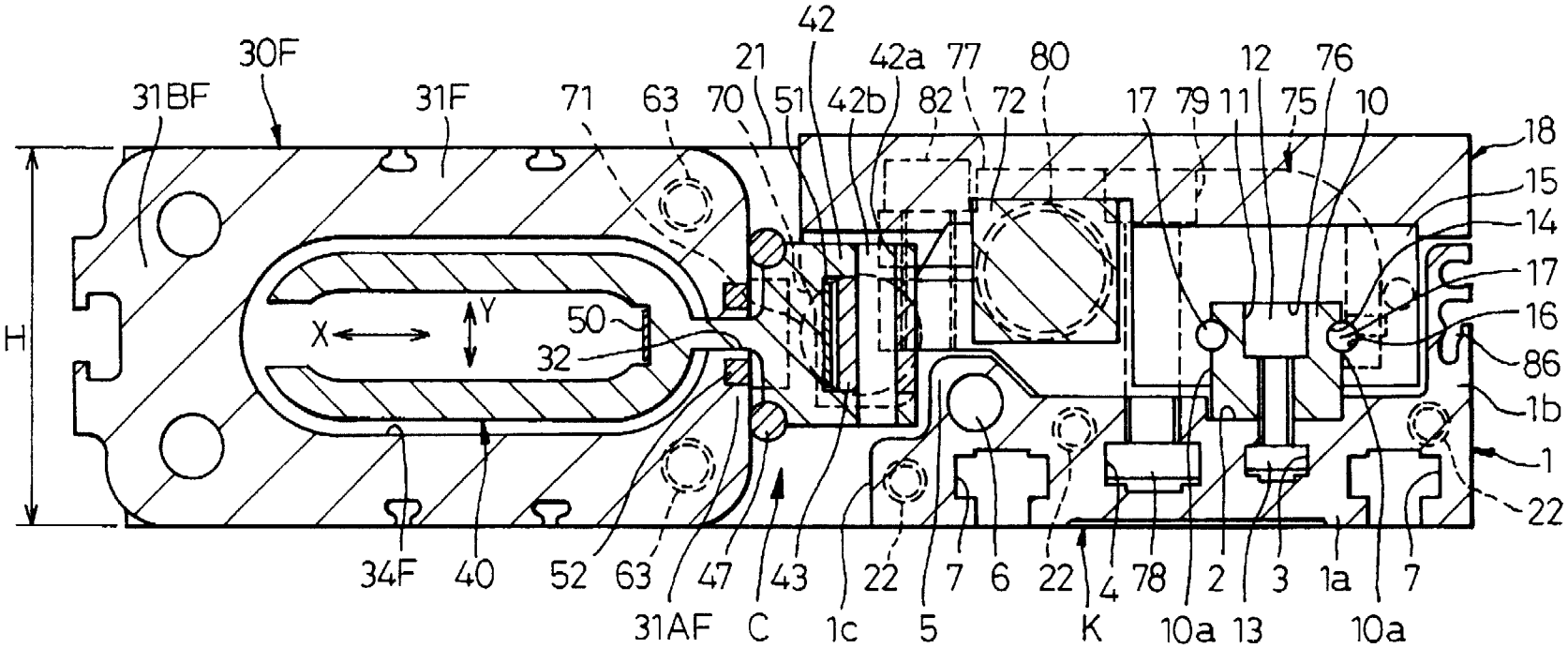
FIG. 10 is a sectional drawing similar to FIG. 9, which shows another embodiment of the linear actuating device according to the present invention.

FIG. 10 shows another embodiment of the present invention. In FIG. 10, reference numerals the same as those in FIGS. 1 through 7 represent the same elements.

The linear actuating device in this embodiment utilizes a flat-type rodless power cylinder unit having a cylinder barrel with non-circular cross section bore.

The cylinder barrel 31F of the flat-type rodless power cylinder unit 30F has an elliptic bore 34F having a major radius (the radius in the direction X in FIG. 10) and a minor radius (the radius in the direction Y in FIG. 10). The cross section of the cylinder barrel 31F is a rectangular shape which matches the shape of the bore 34F. The slit 32 is formed on the shorter side 31AF of the rectangular cylinder barrel 31F. The wall thickness of the side 31AF is made smaller than the wall thickness of the side 31BF opposite to the side 31AF, i.e., the center of the bore 34F is offset to the side 31AF. In this embodiment, the base 1, guide rail 10 and slide table 18 are disposed on the side facing the side 31AF of the cylinder barrel 31F, i.e., similarly to the embodiment in FIGS. 1 through 4, the yoke connecting the piston 40 and the external carriage of the rodless power cylinder unit protrudes in the direction parallel with the bottom 1*a* of the base 1 and the slide table 18. In this embodiment, since the height H of the flat-type rodless power cylinder unit 30F is very small, the height of the linear actuating device can be smaller than that of the previous embodiments.

I claim:

1. A linear actuating device comprising:

a rodless power cylinder unit including a cylinder barrel;

a longitudinal base rigidly coupled to the cylinder barrel, said base having a width in the direction perpendicular to the axis of said cylinder barrel of the rodless power cylinder;

a guide rail mounted on the top face of the base and extending in parallel with the axis of the cylinder barrel, said guide rail capable of bearing both vertical and horizontal forces;

a carriage disposed on the cylinder barrel and movable along the axis of the cylinder barrel;

a slide table having an upper face and lower face disposed in parallel with said base, said slide table being coupled with and driven by said carriage and movable along said guide rail;

wherein said carriage and said slide table are disposed on the side of cylinder barrel facing said guide rail.

2. A linear actuating device according to claim 1, wherein said base has a bottom and said cylinder barrel has a top, the height of said lower face of the slide table measured from the bottom of the base is lower than the height of the cylinder barrel measured from the bottom of the base in the same direction as the measurement of said height of said lower face.

3. A linear actuating device according to claim 1, wherein a portion of said cylinder barrel is overlapped by said slide table when viewed from the direction perpendicular to said upper face.

4. A linear actuating device according to claim 1, wherein said slide table and said cylinder barrel have no overlapped portion when viewed from the direction perpendicular to said upper face.

5. A linear actuating device according to claim 1, where said base has a bottom and said cylinder barrel has a top, the height of the upper face of said slide table measured from the bottom of the base is substantially no higher than the height of the top of the cylinder barrel measured from the bottom of the base in the same direction as the measurement of said height of said upper face.

6. A linear actuating device according to claim 1, wherein said cylinder barrel of the rodless power cylinder unit is mounted to the base by a pair of end plates which are disposed in parallel and rigidly connect both ends of the cylinder barrel to the base.

7. A linear actuating device according to claim 1, wherein said cylinder barrel of the rodless power cylinder unit is embedded in the base in such a manner that the cylinder barrel and the base form an integral part.

8. A linear actuating device according to claim 6, wherein said end plates connect the cylinder barrel to the base by rigidly clamping the cylinder barrel and the base therebetween.

9. A linear actuating device according to claim 1, wherein said rodless power cylinder unit has a piston movable in the bore of the cylinder barrel, and said carriage is coupled to, and driven by, said piston through a slit disposed on the cylinder barrel on the side facing to the guide rail.

10. A linear actuating device according to claim 1, wherein said rodless power cylinder unit has a piston movable in the bore of the cylinder barrel, and said carriage is magnetically coupled, and driven by, said piston.

11. A linear actuating device according to claim 1, wherein said cylinder barrel has a bore having a non-circular cross sectional shape.

12. A linear actuating device according to claim 11, wherein said bore of the cylinder barrel has an elliptic shape with a major radius and a minor radius.

13. A linear actuating device according to claim 1, further comprising a stopper means for defining the end of the stroke of the slide body, said stopper means being provided with:

a stopper member holder having a groove engaging the guide rail so as to facilitate adjustment of the position of said stopper member along the guide rail;

a fastening means for fastening the stopper member holder to the base; and a stopper member mounted on the stopper member holder at a position offset from the guide rail in the direction to the cylinder barrel, said stopper member defining the end of the stroke of the slide body by engaging the slide body at the end of the stroke.

14. A linear actuating device comprising:

a rodless power cylinder unit including a cylinder barrel;

a longitudinal base rigidly coupled to the cylinder barrel, said base having a width in the direction perpendicular to the axis of said cylinder barrel of the rodless power cylinder;

a guide rail mounted on the top face of the base and extending in parallel with the axis of the cylinder barrel;

a carriage disposed on the cylinder barrel and movable along the axis of the cylinder barrel;

a slide table having an upper face and lower face disposed in parallel with said base, said slide table being coupled with and driven by said carriage and movable along said guide rail;

wherein said carriage and said slide table are disposed on the side of cylinder barrel facing said guide rail;

a stopper means for defining the end of the stroke of the slide table, said stopper means being provided with:

a stopper member holder having a groove engaging the guide rail so as to facilitate adjustment of the position of said stopper member along the guide rail;

a fastening means for fastening the stopper member holder to the base; and a stopper member mounted on the stopper member holder at a position offset from the guide rail in the direction to the cylinder barrel, said stopper member defining the end of the stroke of the slide table by engaging the slide table at the end of the stroke; and wherein said fastening means comprises a T-shape cross section groove disposed on the top face of the base and extending in parallel with the guide rail, a nut member accommodated in the T-shape cross section groove, a fastening bolt being screwed into the nut member in the T-shape cross section groove to thereby clamp the stopper member holder to the base, and wherein said nut member has a portion extending in the direction of movement of the slide table from the portion at which the nut member engages with the fastening bolt.

* * * * *